US008896240B2

(12) United States Patent
Dai et al.

(10) Patent No.: US 8,896,240 B2
(45) Date of Patent: Nov. 25, 2014

(54) MULTIFUNCTIONAL ELECTRIC TOOL

(75) Inventors: Youjun Dai, Nanjing (CN); Xiangdong Wang, Nanjing (CN)

(73) Assignee: Chervon (HK) Limited, Hong Kong (HK)

( * ) Notice: Subject to any disclaimer, the term of this patent is extended or adjusted under 35 U.S.C. 154(b) by 250 days.

(21) Appl. No.: 13/525,822

(22) Filed: Jun. 18, 2012

(65) Prior Publication Data

US 2012/0326637 A1 Dec. 27, 2012

(30) Foreign Application Priority Data

Jun. 22, 2011 (CN) ..... 2011 1 0169473

(51) Int. Cl.
*E05B 65/12* (2006.01)
*B25F 3/00* (2006.01)

(52) U.S. Cl.
CPC ..... *B25F 3/00* (2013.01)
USPC ..... 318/4

(58) Field of Classification Search
CPC ..... B60S 1/0491; B60S 1/583; B60S 1/18; E05B 81/25; E05B 81/13; H01H 3/26; B04B 13/003; B23Q 5/341; G02B 6/4452; G09F 19/02
USPC ..... 318/3.4
See application file for complete search history.

(56) References Cited

U.S. PATENT DOCUMENTS

| | | | | |
|---|---|---|---|---|
| 2008/0072438 | A1* | 3/2008 | Bigden et al. | 30/392 |
| 2009/0071671 | A1* | 3/2009 | Zhong et al. | 173/176 |
| 2010/0202842 | A1* | 8/2010 | Whitehead et al. | 408/16 |
| 2011/0272172 | A1* | 11/2011 | Lau et al. | 173/170 |
| 2012/0000409 | A1* | 1/2012 | Railey | 114/55.5 |

OTHER PUBLICATIONS

Canadian Intellectual Property Office, Office Action issued on Canadian patent application No. 2,780,499, dated Nov. 15, 2013, 2 pages.

* cited by examiner

*Primary Examiner* — Bentsu Ro
*Assistant Examiner* — Zoheb Imtiaz
(74) *Attorney, Agent, or Firm* — Greenberg Traurig, LLP

(57) ABSTRACT

A multifunctional electric tool has a housing, a motor arranged in the housing, a transmission device driven by the motor, a speed controlling device. At least two output shafts which have different dimensions are to be used with the tool wherein the output shaft is used to control the activation of the speed controlling device. The rotational speed of the electric tool may thus be automatically adjusted to match with the rotational speed of the accessory installed on the output shaft.

10 Claims, 5 Drawing Sheets

MULTIFUNCTIONAL ELECTRIC TOOL

RELATED APPLICATION INFORMATION

This application claims the benefit of CN 201110169473.0, filed on Jun. 22, 2011, the disclosure of which is incorporated herein by reference in its entirety.

BACKGROUND

The following generally relates to a multifunctional electric tool and, more particularly, to a multifunctional electric tool having an automatic rotational speed adjustment capability.

A multifunctional electric tool enables replacement of different output shafts on the same electric tool. The different output shafts may be equipped with corresponding accessories such as an angle grinding disc of an angle grinder and a polishing pad of a polishing machine. Thus, the electric tool can have different functions by arranging these different accessories. Some of these accessories need to work at a high rotational speed, but some accessories are dangerous at a high rotational speed of operation, and need to work at a low rotational speed. For example, the working rotational speed of the angle grinding disc is generally 11000-12000 r/min, while the working rotational speed of the polishing pad of the polishing machine is generally 3000-5000 r/min. If the accessory does not conform to the working rotational speed set in the electric tool, it cannot work normally. If the rotational speed of the electric tool is interlocked with the accessory installed thereon accordingly, that is to say, if one accessory is replaced, the highest rotational speed of the electric tool will not exceed the needed working rotational speed of the accessory. U.S. Pat. No. 7,431,68 discloses that an accessory is provided with an element for marking the character of the accessory, and a machine body can identify the element and control the machine to operate at a corresponding speed. In the disclosed system, the user needs to buy this special element additionally, which is not convenient for the user. U.S. Pat. No. 5,526,460 discloses that a speed limiting mechanism is arranged on an impacting spanner, thus the operating speed of the device may be set by adjusting the speed limiting mechanism manually. This method limits the rotational speed of the device by manual adjustment, thus it cannot prevent incorrect operation caused by the incorrect operation of the adjustment mechanism.

SUMMARY

The technical problem to be resolved by the present invention is to overcome the defect in the prior art, and to provide a multifunctional electric tool, which enables the rotational speed of the electric tool to be automatically adjusted to meet the requirements of the rotational speed of the installed accessory after replacing an accessory.

In order to resolve the above technical problem, the present invention provides a multifunctional electric tool, comprising a housing, a motor arranged in the housing, a transmission device driven by the motor, a speed control device and at least two replaceable output shafts having different dimensions, wherein the speed control device is controlled and activated by the output shafts.

Preferably, the output shafts have different axial or radial dimensions.

Preferably, the output shafts are provided with corresponding actuating accessories on the ends protruding out of the housing.

Preferably, the speed control device is connected to a printed circuit board (PCB).

Preferably, the speed control device may transmit a speed control signal to the PCB via a wireless transmission device.

Preferably, the speed control device may comprise electronic components for providing a speed control signal for the PCB.

Preferably, the speed control device may generate a magnetic or electric field induction signal as a speed control signal for the PCB.

Preferably, the output shaft is encompassed by an inner output shaft driven by the transmission device and rotatable axially.

Preferably, the output shaft has one end clamped in the housing by a quick clamping device.

Preferably, the quick clamping device may comprise:

- a sleeve movable axially;
- a quick clamping sleeve arranged in the sleeve and fixed relative to the sleeve, the quick clamping sleeve having an inner surface with at least two slanting grooves;
- a locking pin insertable into the output shaft under the action of the slanting grooves; and
- a restoring device for applying a restoring force to the sleeve.

The technical effects of the described tool are as follows: in the multifunctional electric tool the speed control device can be activated through the output shafts being physically different, e.g., by having different axial or radial dimensions, when replacing the accessories and the output shaft. The speed control device may take the form of a switch, a variable resistance, a variable capacitance, multi-sensor, a magnetic field or an electric field for generating different signals, which generates different speed control signals and transmits the speed control signals to the control circuit board of the multifunctional electric tool. The control circuit board may control the motor to generate different rotational speeds according to the different speed control signals. The rotational speed is suited for the accessory installed on the output shaft, thus the rotational speed of the electric tool may be automatically adjusted to match with the rotational speed of the accessory installed on the output shaft. Therefore, the electric tool does not need to be equipped with a special element for indentifying the accessory and to adjust the speed limiting device manually, thus it has a simple structure and can be operated conveniently.

DETAILED DESCRIPTION

Next, an exemplary tool will be explained with reference to the drawings. The following description is only used to explain the technical solutions more clearly, and is not intend to limit the protection scope of the present invention.

Figure 1:
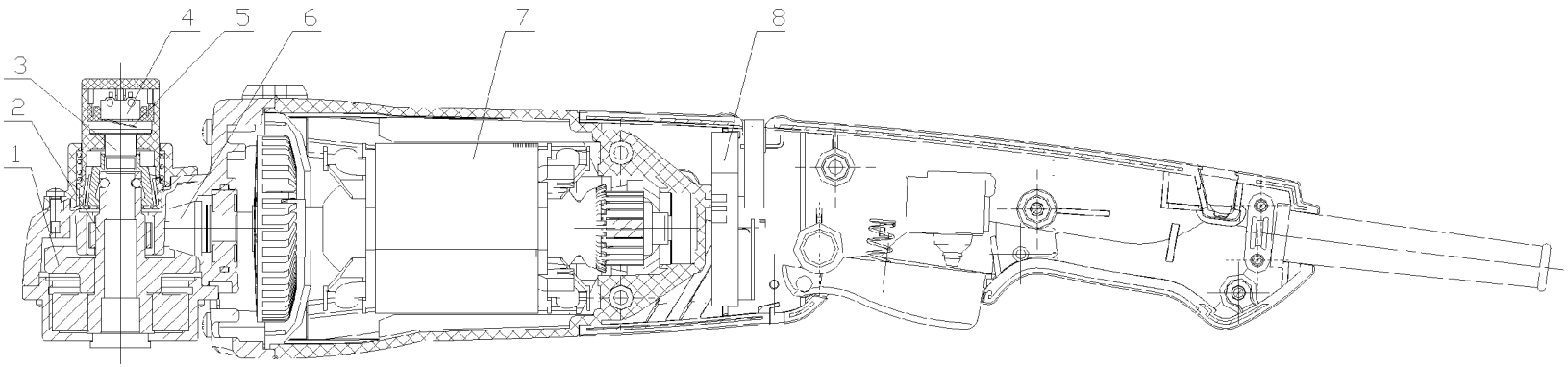
FIG. 1 is a schematic view of an exemplary multifunctional electric tool constructed according to the description that follows in which an output shaft is not installed.
Figure 5:
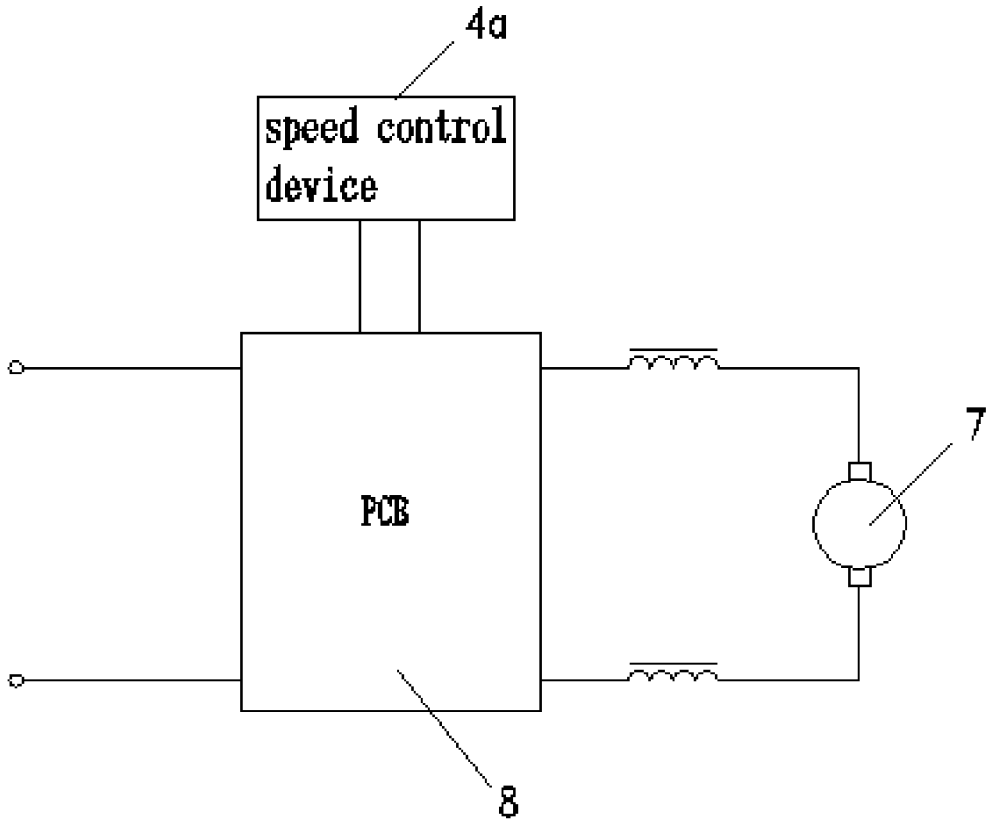
FIG. 5 is a schematic view of the control circuit board.

FIG. 1 is a schematic view of a multifunctional power tool. The multifunctional electric tool includes a motor 7, a small gear 6 and a large gear 1 which are driven by the motor 7 and engaged with each other to rotate, and an inner output shaft 2 arranged in the large gear 1 and driven to rotate by the large gear 1. The inner output shaft 2 is a hollow shaft, and different output shafts such as the output shafts A and B may be installed therein. As shown in FIG. 5, the rotational speed of the motor 7 is controlled by a PCB 8. The electric tool further includes a speed control device 4*a* connected to the PCB 8 and providing a speed control signal to the PCB 8. The electric tool further comprises a transition member 3. In this embodiment, the speed control device 4*a* is a switch 4. The transition member 3 may move upwards and downwards to contact a switch control contact 5 on the switch 4. The transition member 3 may be pushed to move upwards and downwards by the installed output shaft.

Taking a multifunctional electric tool with installed accessories having two rotational speeds for example. The switch 4 is a normal switch having two levels. Two output shafts having different axial lengths may be installed corresponding to the on state and off state respectively, thereby achieving an automatic adjustment between two rotational speeds. In other embodiments, various output shafts provided with an accessory and having different axial lengths may be installed according to the desired rotational speed. And a switch having corresponding levels may be chosen, thereby achieving an automatic adjustment between various rotational speeds.

Figure 2:
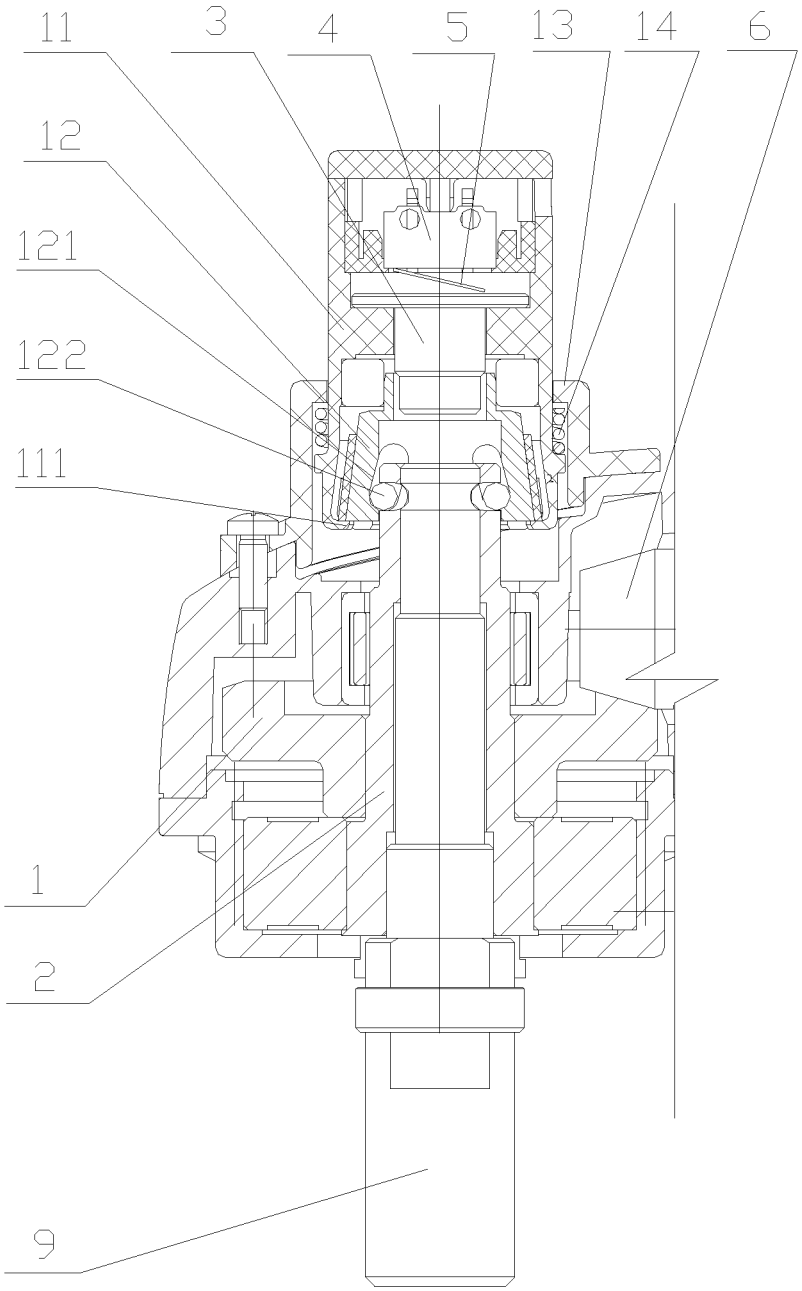
FIG. 2 is a schematic view showing installation of the output shaft A with the tool of FIG. 1.
Figure 3:
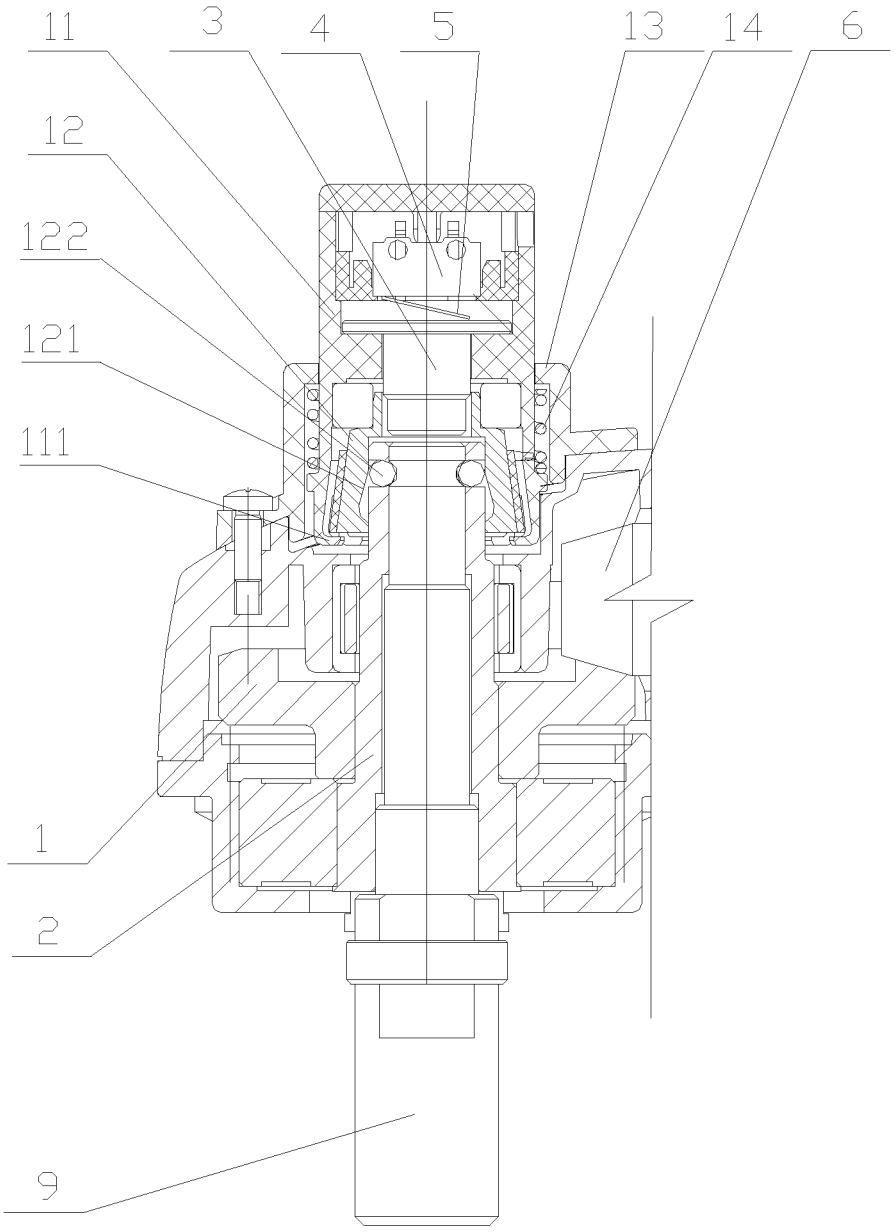
FIG. 3 is a schematic view of the end of the multifunctional electric tool with the output shaft A installed.

As shown in FIG. 2, when it is needed to use the accessory A, an output shaft 9 with the accessory A may be installed firstly. The installing process of the output shaft 9 is as follows. Firstly, a sleeve 11 is pulled upwards so that a spring 14 between the sleeve 11 and the upper cover 13 is compressed. A blocking hook 111 extending inwards from the lower end of the sleeve 11 may brings a quick clamping sleeve 12 fixed relative to the sleeve 11, the switch 4, the transition member 3 and a bearing to move upwards together. Two slanting grooves 121 on the quick clamping sleeve 12 may force two locking pins 122 to move toward two opposite sides, and now the output shaft 9 can be inserted. Then, the sleeve 11 is released, and restores to its initial position under the action of the spring 14. As a result, the quick clamping sleeve 12 fixed relative to the sleeve 11, the switch 4, the transition member 3 and the bearing is moved downwards to their initial positions. The two slanting grooves 121 in the inner side surface of the quick clamping sleeve 12 may push the two locking pins 122 to move inwards gradually. Finally, the two locking pins 122 reach their upper limiting positions in the two slanting grooves 121, and are just snapped into the grooves of the output shaft 9. At this time, the output shaft 9 is locked, as shown in FIG. 3.

Since the output shaft 9 is relatively short, it cannot contact the transition member 3 after being installed. As a result, the transition member 3 may not move upwards, nor contact the switch control contact 5 on the switch 4, in the absence of a pushing force. Thereby the switch 4 is in off state. When the switch 4 is in off state, the voltage of the motor 7 provided by the PCB 8 which is connected to the switch 4 may vary in a certain range. The rotational speed of the motor 7 may vary in a certain range accordingly. And the rotational speed of the output shaft 9 driven by the motor 7 may also vary in a certain range. At this moment, the rotational speed of the output shaft 9 meets the requirement of the rotational speed of the accessory A installed on the output shaft 9 and would not exceed its limiting rotational speed.

Figure 4:
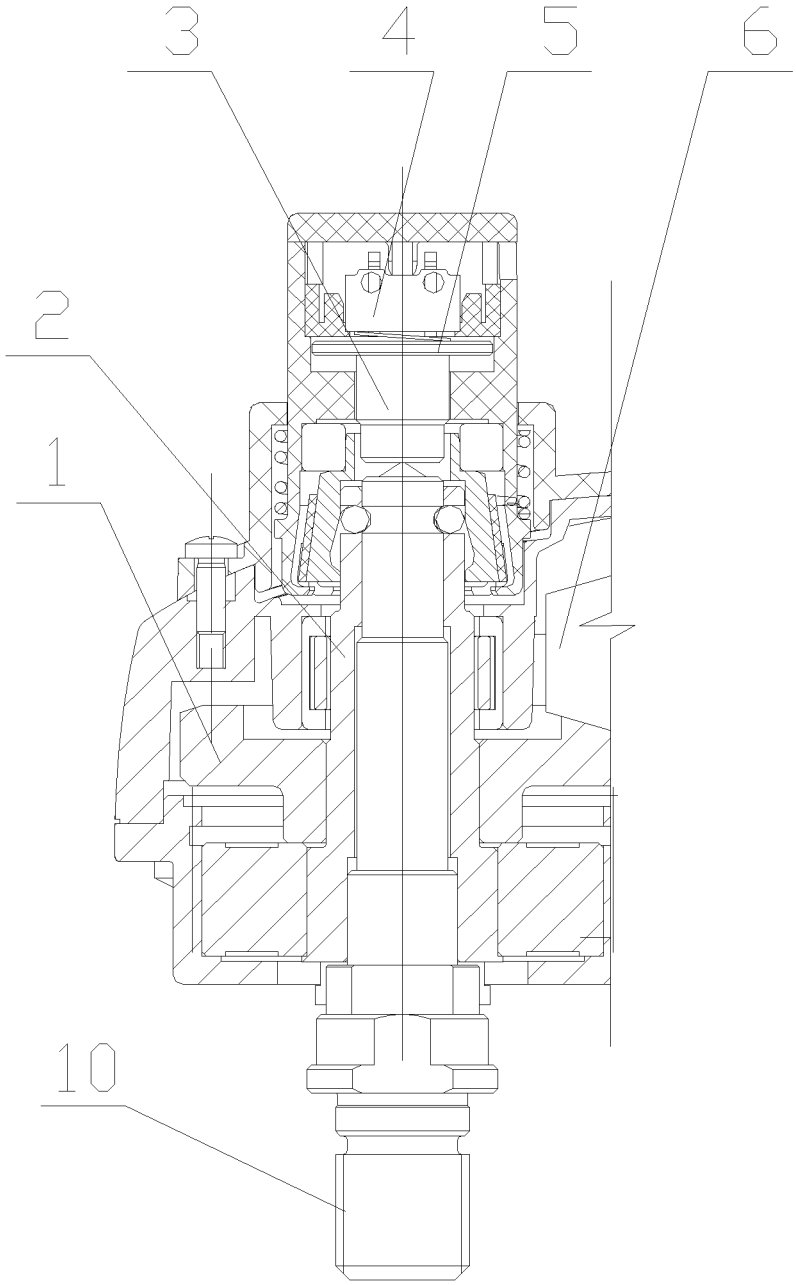
FIG. 4 is a schematic view of the end of the multifunctional electric tool with the output shaft B installed.

When it is needed to use the accessory B, an output shaft 10 with an accessory B will be installed. The installing process of the output shaft 10 is similar to that of the output shaft 9, thus it is unnecessary to go into details here. FIG. 4 shows a schematic view after the output shaft 10 is installed.

Since the output shaft 10 is relatively long, the installed output shaft 10 may push the transition member 3 to move upwards, and to contact the switch control contact 5 on the switch 4. As a result, the switch 4 is switched on, as shown in FIG. 4. When the switch 4 is switched on, the voltage of the motor 7 provided by the PCB 8 which is connected to the switch 4 may vary in another certain range. The rotational speed of the motor 7 may vary in another certain range accordingly. And the rotational speed of the output shaft 10 driven by the motor 7 may also vary in another certain range. At this moment, the rotational speed of the output shaft B10 meets the requirement of the rotational speed of the accessory B installed on the output shaft B10 and cannot exceed its limiting rotational speed.

In a further example, an electric element for controlling the resistance value through the stroke is connected to the PCB. Considering output shafts A, B and C having different lengths, since the output shaft A is short, it cannot push the contact of the electric element when the output shaft A is installed to the multifunctional electric tool. At this moment, the resistance value is an initial value R0 (R0 is a value in a certain range, and R1 and R2 mentioned hereinbelow are the same). According to the resistance value R0, the PCB may set the output voltage in a certain range. The rotational speed of the multifunctional electric tool may vary in a certain range accordingly. Thus the rotational speed of the output shaft A meets the requirement of the rotational speed of the accessory A installed on the output shaft A.

When the output shaft B is installed, since the output shaft B is longer than the output shaft A, the output shaft B can push the contact of the variable resistance of the electric element directly or indirectly to a first position, and the resistance value is R1. According to the resistance value R1, the PCB may set the voltage of the PCB in another corresponding range. The rotational speed of the multifunctional electric tool is set in another range accordingly. Thus the rotational speed of the output shaft B meets the requirement of the rotational speed of the accessory B installed on the output shaft B. In keeping with this example, when the still longer output shaft C is installed, the multifunctional electric tool may adjust the rotational speed in various ranges of rotational speed.

From the foregoing, those skilled in the art will appreciate that the connection form of the speed control device and PCB need not be limited to wire connection, and wireless connection is also possible.

Those skilled in the art will also understand that the output shaft may by used to control the rotational speed of the motor not only by having different axial dimensions, but also by having different radial dimensions.

Those skilled in the art will further understand that the speed control device need not be limited to a switch or a variable resistance, but also can use electric elements such as a variable capacitance or a variable inductance to provide a speed control signal for the PCB, or use a displacement transducer or other transducers to collect the speed control signal outputted from the speed control device and transmit the signal to the PCB, and then the PCB outputs a signal to control the rotational speed of the motor. It will likewise be understood that the signals induced by the magnetic field or electric field may be used as the speed control signal provided for the PCB.

While the above sets forth preferred embodiments of the present invention, it should be noted that a person skilled in the art may make various modifications and changes to such described embodiments without departing from the technical principle of the present invention. Any such modifications and changes should be considered to fall within the protection scope of the invention claimed hereinafter.

What is claimed is:

1. A multifunctional electric tool, comprising:

a housing;

a motor arranged in the housing;

a transmission device driven by the motor;

a speed control device; and at least two replaceable output shafts having different axial dimensions connected to the transmission device, wherein the speed control device comprises a switch having different output levels corresponding to the different axial dimensions of the output shafts, and wherein the speed control device is controlled and activated in response to the different axial dimensions of the output shafts.

2. The multifunctional electric tool according to claim 1, wherein the output shafts also have different radial dimensions.

3. The multifunctional electric tool according to claim 1, wherein the output shafts are provided with corresponding actuating accessories on the ends protruding out of the housing.

4. The multifunctional electric tool according to claim 1, wherein the speed control device is connected to a circuit board.

5. The multifunctional electric tool according to claim 4, wherein the speed control device transmits a speed control signal to the circuit board via a wireless transmission device.

6. The multifunctional electric tool according to claim 4, wherein the speed control device comprises electronic components for providing a speed control signal for the circuit board.

7. The multifunctional electric tool according to claim 4, wherein the speed control device generates a magnetic or electric field induction signal as a speed control signal for the circuit board.

8. The multifunctional electric tool according to claim 1, wherein each of the output shafts is insertable into an inner output shaft which is axially rotably driven by the transmission device.

9. The multifunctional electric tool according to claim 1, comprising a quick clamping device associated with the housing for clamping each of the output shafts when coupled to the tool.

10. The multifunctional electric tool according to claim 9, wherein the quick clamping device comprises:

a sleeve movable axially;

a quick clamping sleeve arranged in the sleeve and fixed relative to the sleeve, the quick clamping sleeve having an inner surface with at least two slanting grooves;

a locking pin insertable into the output shaft under the action of the slanting grooves; and a restoring device for applying a restoring force to the sleeve.

* * * * *